US007913519B2

(12) United States Patent
Veeser

(10) Patent No.: US 7,913,519 B2
(45) Date of Patent: Mar. 29, 2011

(54) LATCH NEEDLE WITH ROTATING SWIVEL PIN

(75) Inventor: Jurgen Veeser, Nusplingen (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 12/712,785

(22) Filed: Feb. 25, 2010

(65) Prior Publication Data

US 2010/0212366 A1 Aug. 26, 2010

(30) Foreign Application Priority Data

Feb. 26, 2009 (EP) ..... 09153821

(51) Int. Cl.
*D04B 35/04* (2006.01)

(52) U.S. Cl. ..... 66/122

(58) Field of Classification Search ..... 66/121, 66/116, 122, 119, 123
See application file for complete search history.

(56) References Cited

U.S. PATENT DOCUMENTS

| | | | | |
|---|---|---|---|---|
| 600,692 | A * | 3/1898 | Huke et al. | 66/122 |
| 2,711,218 | A * | 6/1955 | Vitoux | 66/122 |
| 3,459,009 | A * | 8/1969 | Strohlein et al. | 66/122 |
| 3,677,035 | A * | 7/1972 | Wiederhut et al. | 66/122 |
| 4,548,056 | A * | 10/1985 | Schuler et al. | 66/121 |
| 4,723,425 | A * | 2/1988 | Majer | 66/122 |
| 4,747,277 | A * | 5/1988 | Majer | 66/122 |
| 4,776,010 | A | 10/1988 | Noda et al. | |
| 4,781,040 | A * | 11/1988 | Koike | 66/121 |
| 4,817,398 | A | 4/1989 | Sos et al. | |
| 5,509,280 | A * | 4/1996 | Schuler et al. | 66/121 |
| 7,007,516 | B2 * | 3/2006 | Sauter | 66/121 |

FOREIGN PATENT DOCUMENTS

| | | |
|---|---|---|
| DE | 360692 | 10/1922 |
| DE | 917243 | 8/1954 |
| DE | 1906892 | 5/1970 |
| DE | 3545037 | 7/1986 |
| DE | 3600621 | 5/1987 |
| EP | 0291687 | 12/1988 |
| GB | 711841 | 7/1954 |

* cited by examiner

*Primary Examiner* — Danny Worrell
(74) *Attorney, Agent, or Firm* — Fitch, Even, Tabin & Flannery; Norman N. Kunitz

(57) ABSTRACT

The knitting needle 1 comprises a novel bearing arrangement 16 for its latch 10. The bearing arrangement 16 comprises a swivel pin 20 that is positively and non-rotationally coupled with the latch. An anti-loosening safety may be provided on the base body 2 of the latch needle 1 in order to axially secure the swivel pin 20 in the latch hole 17. Alternatively, the swivel pin 20 may be connected with the latch 10 in order to axially secure said swivel pin.

12 Claims, 3 Drawing Sheets

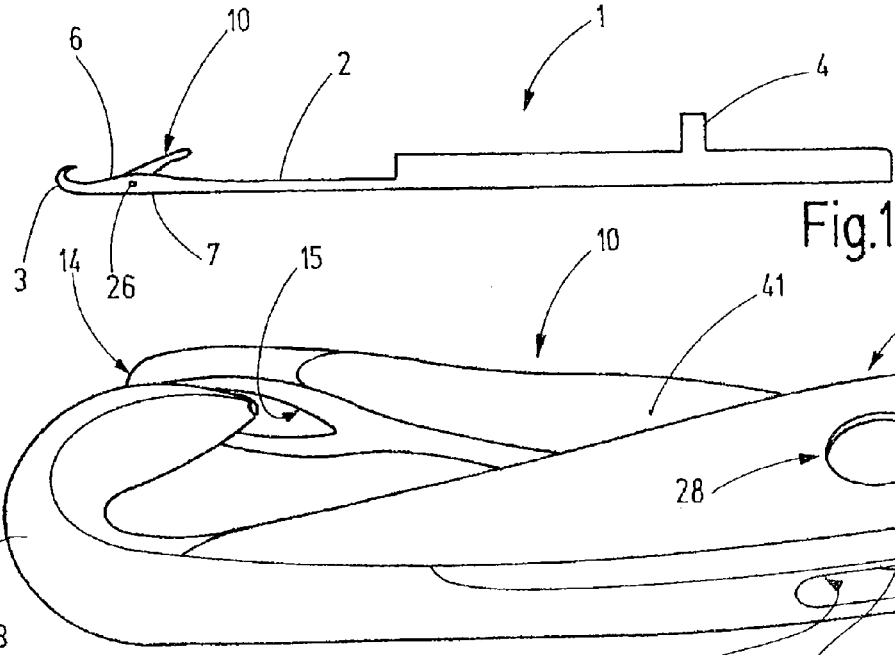
Fig.1
Fig.2
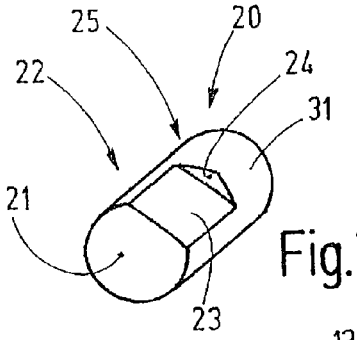
Fig.3
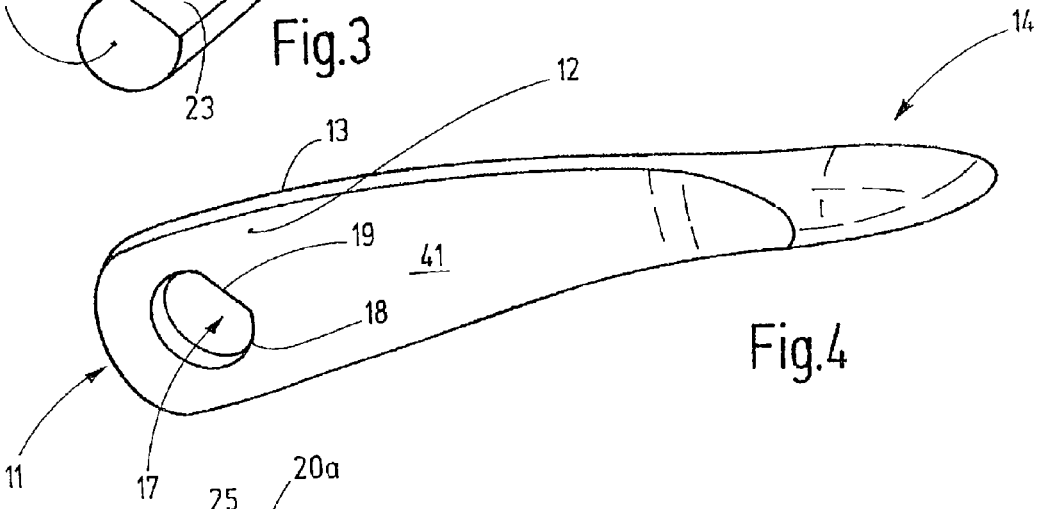
Fig.4
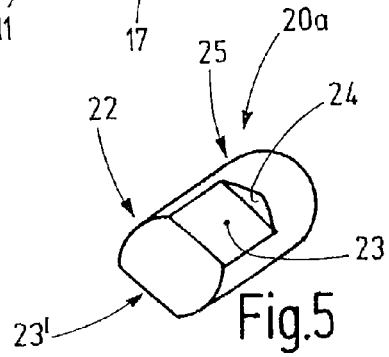
Fig.5
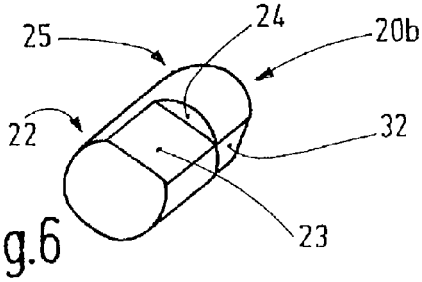
Fig.6

LATCH NEEDLE WITH ROTATING SWIVEL PIN

CROSS-REFERENCE TO RELATED APPLICATION

The present application claims the priority of European Patent Application No. 09 153 821.5, filed Feb. 26, 2009, the subject matter of which, in its entirety, is incorporated herein by reference.

BACKGROUND OF THE INVENTION

The invention relates to a latch needle that may be used in textile machines. Such textile machines are, for example, circular knitting machines, flat-bed knitting machines or hosiery machines.

A latch needle, as has basically been known from publication DE 36 00 621 C1, has a base body with an end-side hook. The base body is provided with a latch slot in the vicinity of the hook. One end of a latch that is disposed for opening and closing the hook projects into the latch slot. A latch hole is provided on one end of the latch, where a swivel pin extends through said latch hole. The latch slot is delimited by two slot walls. A wall hole is provided in each slot wall. Both wall holes are in alignment with each other. The swivel pin extends through the latch hole and is held by its ends in the wall holes. The outside edges of the two wall holes are deformed radially inward so that the swivel pin is held firmly in place in its axial direction.

Considering this solution, the latch hole of the latch is pivotally supported on the stationary swivel pin. Here, any potential wear of the bearing is concentrated on relatively small surfaces.

Similar solutions have been known from German Patent 14407 and publication DE 36 0692 A1.

German Patent 917243 and German Auslegeschrift 1906892 disclose latch needles with a co-rotating swivel pin. In so doing, DE 917243, FIG. 2, provides a latch hole that has a smaller diameter than the wall holes. The swivel pin consists of plastic material and has a diameter greater than the latch hole, however, a diameter smaller than the wall holes. If said swivel pin is drawn into the latch hole with appropriate force, said pin will be seated in said hole in a force-fit manner. The ends of the swivel pin that project from the latch are rotatably supported in the wall holes.

As opposed to this, DE 1906892 is based on a swivel pin of steel. Again, the latch hole has a smaller diameter than the wall holes. The swivel pin that is inserted in the latch hole is axially upset, so that it is seated in the latch hole in a force-fit manner. The ends projecting from the latch hole form rivet heads having the form of a truncated cone, said rivet heads being rotatably supported in the wall holes.

Whereas the aforementioned publications basically assume the use of swivel pins having essentially two equally configured ends, DE 35 45 037 C2 provides a swivel pin that is arranged asymmetrically with respect to the latch. In this case, only one slot wall is provided with a wall hole that receives the swivel pin. The oppositely arranged slot wall does not have a wall hole. The front side of the swivel pin abuts against this slot wall. Again, the latch is rotatably supported by the round swivel pin.

To the extent that the aforementioned solutions relate to swivel pins that co-rotate with the latch, said solutions are based on a force fit between the latch and the swivel pin. Considering mass production, the precise manufacture of such bearing arrangements may result in quality problems.

Considering this, it is the object of the invention to provide a latch needle with a bearing arrangement that combines great precision with good wear resistance.

SUMMARY OF THE INVENTION

The above object generally is achieved with a latch needle that in accordance with the invention comprises a swivel pin that is non-rotationally connected with the latch. The non-rotational securing of the swivel pin on the shaft of the latch occurs by positive connection. This is achieved by a non-round cross-section of the latch hole in the latch shaft. Preferably, the swivel pin also has a matching non-round cross-section. Alternatively, said latter cross-section may adapt to the non-round cross-section of the latch hole if an appropriate deformability of the material is given. Also, a swivel pin that is non-round at least in sections can be used, said swivel pin reshaping an originally differently formed latch hole so as to be non-round. This force fit that is achieved in this or also another manner may be disposed to axially secure the swivel pin in the latch hole, whereby the simultaneously occurring positive connection effects the non-rotational connection between the swivel pin and the latch.

The positive connection between the swivel pin and the latch hole effectively and durably prevents a twisting of the swivel pin relative to the latch. In so doing, it can be ensured that the swivel pin with its two ends projecting from the latch hole acts as a bearing, whereby the corresponding counter bearing surfaces are formed by the walls of the two wall holes. Friction and wear are distributed over a relatively large surface, thus resulting in lasting durability. Therefore, the two bearings supporting the swivel pin are formed in the walls that delimit the latch slot. The existing bearing clearance reduces the tilting tendency of the latch, so that, in addition to the latch being guided through the slot walls, another means is provided for guiding the latch in an improved precise manner.

The non-round cross-section of the latch hole and the positive connection between the latch shaft of the latch and the swivel pin ensure that the swivel pin will always co-rotate with the latch. Even when the wall holes are loaded with debris, for example abraded materials, dust and the like, and the swivel pin is slowed as a result of this, the latch is still prevented from starting to rotate on the swivel pin.

Preferably, the swivel pin has at least a first section, said section having a cross-section that matches the cross-section of the latch hole. This first section ensures the positive connection between the latch hole and the non-round cross-section of the swivel pin. This first section may be configured, for example, as a cylinder whose lateral cylinder surface has at least a notch, a flattened area or the like. Adjoining this first section, there is—optionally but preferably—a second section that has an abutment surface facing the latch. When the swivel pin is inserted into the latch hole, said abutment surface ensures that the swivel pin is guided into the desired central position, in which both ends of the swivel pin project at approximately the same distance from the latch hole.

It is possible to provide only the first section of the swivel pin with a non-round cross-section and to configure the second section of the swivel pin in a cylindrical manner. Alternatively, it is also possible to provide both sections with a non-round cross-section. The first and the second sections may optionally be twisted relative to each other in order to provide an abutment surface on the swivel pin for centering said swivel pin as explained above. Two non-round cross-sections may be of significance when the non-round swivel pin cross-section is to be used to free the wall hole from debris/contaminants during the rotation of the latch.

Optionally, the swivel pin may be seated with minimal play as well as be tightly fitted, or be oversized, in the latch hole. If a fit with play exists between the swivel pin and the latch hole, it is only the walls delimiting the latch slot that provide a lateral guide for the latch. It may also be advantageous for the pairing of the swivel pin and the latch hole to be configured in such a manner that, as a result of this, an improved guidance of the latch is ensured. In this case, it is advantageous if the swivel pin is seated in a tightly fitted or force-fit manner in the latch hole. As a result of this, a lateral tilting tendency is largely or even completely prevented. The swivel pin is held firmly by the force fit and need not be secured separately in axial direction.

If the swivel pin is not seated in the latch hole in a force-fit manner or fastened to the latch in any other way, it may be advantageous to provide an anti-loosening safety on one of the slot walls. This safety feature prevents the swivel pin from being able to fall out of the needle body. This anti-loosening safety is configured as a means that reduces the diameter of the latch hole. As a rule, the anti-loosening safety is applied after the swivel pin has been mounted and can thus be provided by the application of material (welding, gluing, etc.). Such an anti-loosening safety may be provided, for example, in that the outer edge of the wall hole is deformed in a somewhat radially inward manner, so that said edge extends around the end face of the swivel pin. Alternatively or additionally, it is possible to slightly upset the swivel pin on the outer end of the first section, so that said pin is held in the latch hole in a manner that said pin cannot be lost.

Additional details of advantageous embodiments of the invention are obvious from the drawings, the description or the claims. The description is restricted to essential aspects of the invention and other situations. The drawings are to be referred to as being supplementary.

BRIEF DESCRIPTION OF THE DRAWINGS

FIG. 1 is a schematic side view of a latch needle.

FIG. 2 is a partial and perspective representation of the latch needle in accordance with FIG. 1.

FIG. 3 is a perspective representation of the swivel pin of the latch needle in accordance with FIG. 2.

FIG. 4 is a perspective representation of the associate latch of the latch needle in accordance with FIG. 2.

FIGS. 5 and 6 are perspective representations of alternative embodiments of the swivel pin for the latch in accordance with FIG. 4.

DETAILED DESCRIPTION OF THE INVENTION

Figure 7:
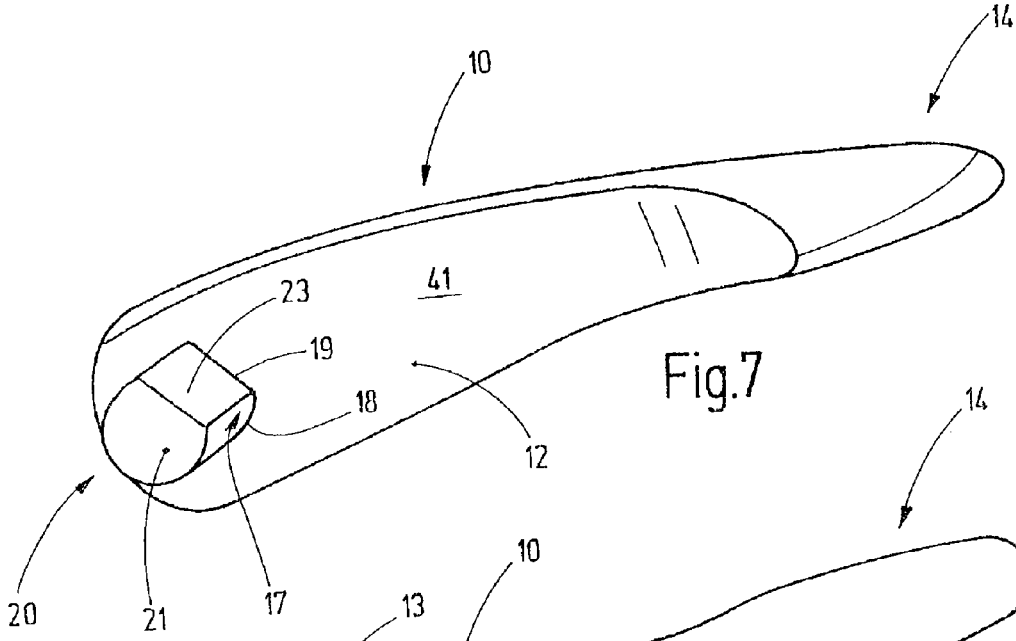
FIGS. 7 and 8 are perspective representations of the latch in accordance with FIG. 4, with the swivel pin inserted.

FIG. 1 is a schematic representation of a latch needle 1 as is used, for example, in knitting machines or also, in modified form, in hosiery machines. The latch needle 1 has an elongated needle body 2 that is provided with a hook 3 on one end. The other end of the needle body is disposed to act as a guide and/or bearing for the latch needle in a needle bed or a sinker. A driving foot 4 may be provided for knitting machines that require a relative movement between the needle bed and the latch needle 1.

In the vicinity of the hook 3, there is a latch slot 5 that extends from the needle breast 6 to the needle back 7, preferably in a continuous manner. The latch slot 5 shown, a detail of which is shown in FIG. 2, is delimited by two walls 8, 9, also slot walls, that are preferably arranged parallel to each other and have essentially the same configuration on their opposing internal sides. A latch 10 that is disposed for opening and closing the hook extends with one end 11 into the latch slot 5, said end delimiting the latch shaft 41 (FIG. 4). The latch shaft 41 is preferably delimited by two flat sides 12, 13.

The elongated latch 10 has an end 14 that is, for example, configured as a spoon, said end 14 being remote from the end 11 and, as is shown by FIG. 2, being able to abut against the tip of the hook 3 in closed position of the latch 10. A recess 15 (that is also referred to as a "saw cut") that is provided on the widened end 14 and faces the hook 3 can accommodate the tip of the hook 3. However, it is pointed out that, alternatively, it is also possible to provide the hook 3 on its upper side with a longitudinally aligned notch (also referred to as a "saw cut"), into which fits a narrow strip provided on the latch 10. The latter type of needle is also referred to as a "male latch-female hook type needle".

The latch 10 is pivotally supported in the latch slot 5 by means of a bearing arrangement 16. To do so, the latch 10 has a latch hole 17 that leads from one lateral surface 12 to the other lateral surface 13. The latch hole 17 is non-round. For example, as shown in FIG. 4, said latch hole has a cross-section that is flattened on one side. Its edge is created by a part 18 that has the form of a circular arc and a part 19 that is straight.

In addition, the bearing arrangement 16 comprises a swivel pin 20, as is obvious from FIG. 3, for example. The swivel pin 20 is based on a cylindrical basic shape that extends between its two end faces 21 and 31. Starting at one of the end faces 21 of the swivel pin 20, said swivel pin has a first section 22 that deviates from the cylindrical form. At another location of its circumference, the circumference is provided with a flattened area that has an axially aligned, e.g., plane, surface 23. The surface 23 that is to be measured (in circumferential direction) transversely with respect to the central axis of the basic cylindrical form of the swivel pin 20 corresponds to the length of the straight part 19 of the edge of the latch hole 17. Viewed in axial direction of the swivel pin 20, the surface 23 has a length that is preferably smaller than the total length of the swivel pin 20. The remaining circumference of the first section 22 follows the part 18 of the latch hole, said part having the form of a circular arc, so that the first section 22 fits into the latch hole 17 with minimal or no play.

Figure 8:
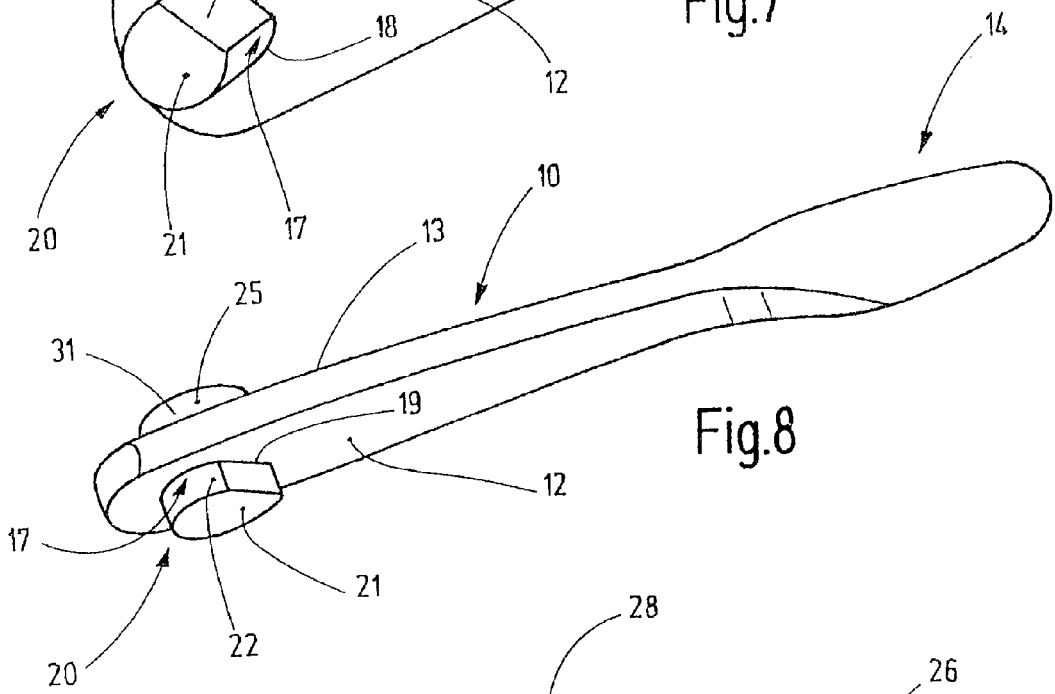

Adjoining the surface 23 there is—optionally but preferably—an abutment surface 24 that separates the first section 22 from the second section 25 of the swivel pin 20. The first section 22 is preferably longer by the thickness of the latch 10 than the second section 25, i.e., with respect to the longitudinal direction of the swivel pin 20. The thickness of the latch 10 is defined as the distance between the lateral surfaces 12, 13. The abutment surface 24 is transverse to the surface 23 and is essentially parallel to the lateral surface 12 or 13. As is shown by FIGS. 7 and 8, the swivel pin 20 fits into the latch hole 17 of the latch 10. The first section 22 may be inserted through the latch hole 17 until the abutment surface 24 of the second section 25 abuts against the lateral surface 13. Consequently, the end faces 21, 31 of the swivel pin 20 project beyond the lateral surfaces 12, 13. The two parts of the swivel pin 20 projecting from the latch hole 19 have preferably the same length. In addition, they preferably have the same diameter. Whereas the part of the swivel pin 20 projecting beyond the lateral surface 13, i.e., section 25, forms a cylindrical journal, the part of the swivel pin 20 that projects beyond the lateral surface 19 also essentially forms a cylindrical journal that is, however, in fact slightly flattened in one area.

Figure 9:
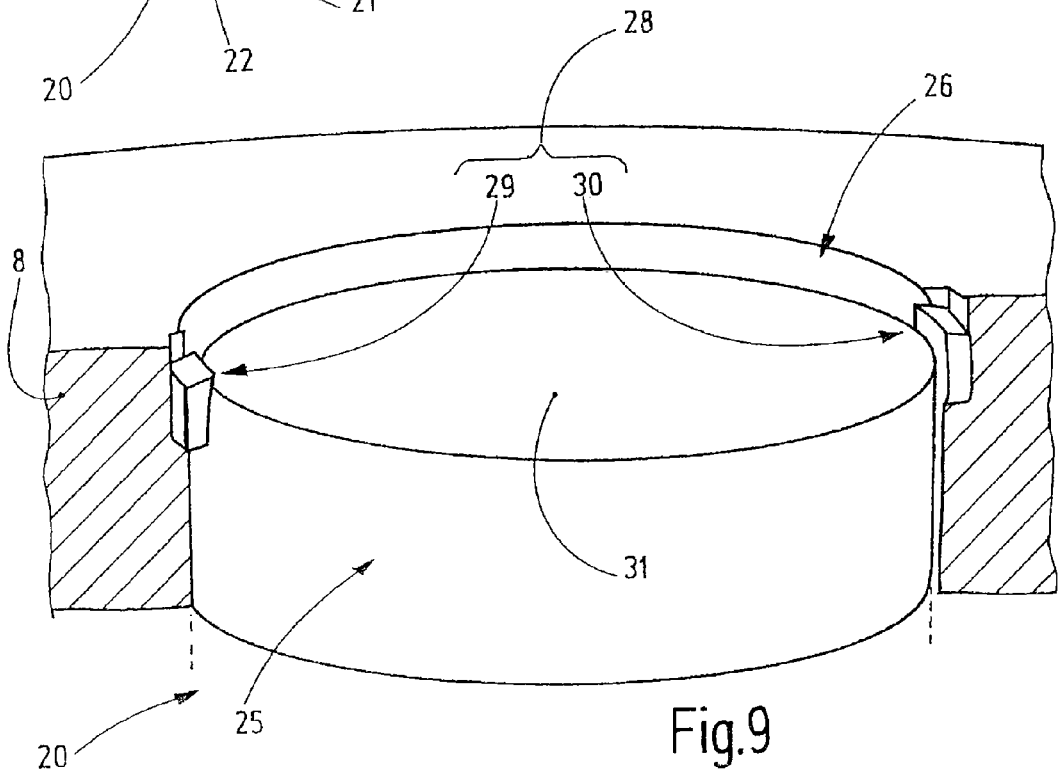
FIG. 9 is a perspective representation of a longitudinal section through a slot wall to illustrate the axial securing of the swivel pin.
Figure 13:
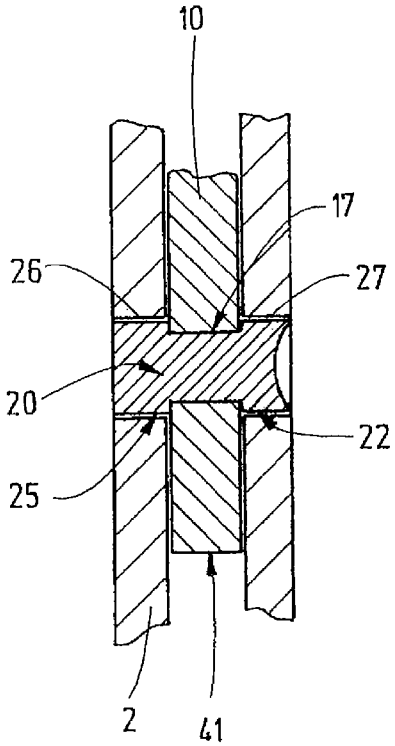
FIG. 13 is an illustration of a detail of a longitudinal section through an alternative embodiment of the latch needle in accordance with the invention.

Wall holes 26, 27—only one of them being shown in FIGS. 1 and 2, however both being represented in the other embodiment in accordance with FIG. 13—in the slot walls 8, 9 act to accommodate the parts of the swivel pin 20 projecting from the latch 10. For example, it is possible to push the swivel pin 20 from one side through the wall hole 26 into the needle body 2 through the latch hole 17 and into the other wall hole 27. An anti-loosening safety may be provided to prevent the swivel pin 20 from again falling out of the wall hole 26. This anti-loosening safety consists, for example, of reshaped regions 29, 30 of the edge of the wall hole 26. These regions may be achieved by plastic deformation and extend around the end face 31 of the section 25 of the swivel pin 20. The relationships are schematically shown in FIG. 9. The reshaped regions 29, 30 do not impair the rotatability of the swivel pin 20.

The latch needle 1 described so far can be used as any other conventional latch needle 1. During operation, the latch 10 performs a pivoting movement out of the closed position shown in FIG. 2 into a rear position, for example, in accordance with FIG. 1. During the pivoting movement of the latch 10, the swivel pin 20 co-rotates with the latch 10. Due to its cross-sectional form that is different from the circular form in section 22 and corresponds to the cross-sectional form of the latch hole 17, the swivel pin 20 is in positive connection with the latch 10. The regions of the swivel pin 20 as are obvious from FIG. 8, said regions projecting beyond the lateral surfaces 12, 13 on both sides, act as latch-side bearing surfaces. The internal walls of the wall holes 26, 27 act as counter bearing surfaces. The thusly formed bearing arrangement 16 displays high wear-resistance, can be reliably manufactured with great precision, and offers a good lateral guide for the latch 10, so that the latch 10 reliably meets the hook 3, even in situations of advanced wear.

FIG. 5 shows a swivel pin 20a that may be used as an alternative to the swivel pin 20 in accordance with FIG. 3 on the latch 10 in accordance with FIG. 4. The latter swivel pin is different from the swivel pin 20 in that it has—parallel to the flattened area represented by the surface 23—another such flattened area 23' on the opposite side of section 22. This swivel pin 20a fits into the latch hole 17 in accordance with FIG. 4. It is also possible to provide a modified latch hole that has another matching straight part located opposite the straight part 19.

Whereas the swivel pins 20 and 20a have different cross-sections in their sections 22 and 25, it is also possible to provide both sections 22 and 25 with the same cross-section. FIG. 6 illustrates such an exemplary embodiment with the use of the swivel pin 20*b*. Section 25, like section 22, is flattened. To accomplish this, it has on its circumference a plane surface 32 with a surface normal that—like the surface normal of surface 23—extends in radial direction. However, the two radial directions of the two surface normals deviate from each other, so that section 25, again, has an abutment surface 24 as its termination, said abutment surface 24 bordering the surface 23.

Figure 10:
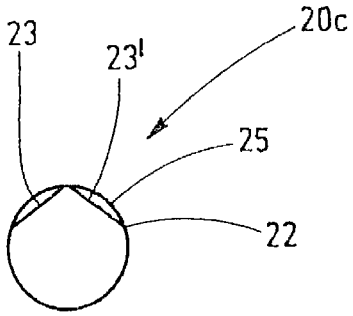
FIGS. 10 through 12 are front views of alternative cross-sections of the swivel pin.
Figure 11:
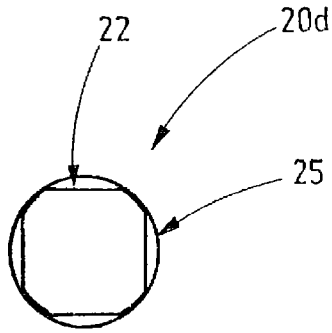
Figure 12:
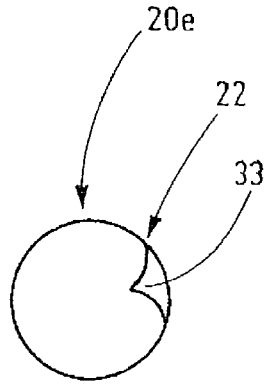

FIGS. 10 through 12 illustrate additional embodiments of the swivel pins 20*c*, 20*d*, and 20*e*. Referring to the swivel pin 20*c* in accordance with FIG. 10, the first section 22 has two adjacent facets or surfaces 23, 23', which, with a correspondingly formed latch hole, achieve a positive-locking non-rotational coupling between the swivel pin 20*c* and the latches. The second section 25, as indicated, may be cylindrical or also have another form, for example, may have flattened areas at other circumferential locations.

The swivel pin 20*d* shown in FIG. 11 represents another embodiment. Here, the first section 22 is configured as a polygon, in particular as a four-sided polygon with rounded corners. The second section 25 is cylindrical; however, it may deviate from the cylindrical form.

FIG. 12 shows a journal 20*e* having a first section 22 with a peripheral notch 33, said notch forming a positive connection with a corresponding projection on the latch hole 17.

Considering the above-described embodiments, it was assumed that the swivel pin 20 (20*a* through 20*e*) was inserted into the latch hole 17 with only minimal force. Consequently, a separate non-loosening safety is required such as, for example, the non-loosening safety 28, said safety then being provided on the needle body 2.

FIG. 13 illustrates a modified embodiment that can be used for all of the above-explained swivel pin cross-sections. This embodiment is particularly suitable for symmetrical swivel pin cross-sections in accordance with FIG. 5 or FIG. 11, for example. For this, as is shown by FIG. 13, the swivel pin 20 is slightly upset on its section 22 that extends into the wall hole 27. Consequently, due to its form matching the latch hole, the swivel pin 20 is non-rotationally coupled with the latch shaft 41 of the latch 10. Relative to its axial direction (that is the transverse direction with respect to the latch 10), the swivel pin is held in a non-loosening manner on the rivet head 34 on section 22, said rivet head having been obtained by the upsetting process.

Figure 14:
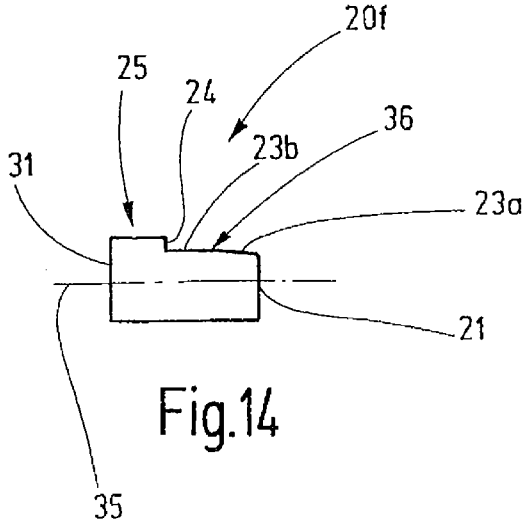
FIG. 14 shows another alternative embodiment of the swivel pin.

FIG. 14 shows another embodiment of the swivel pin 20*f*. The principle as explained with reference to this swivel pin 20*f* can be applied to all forms of swivel pins. This principle consists in that the swivel pin 20*f* is supported in the latch hole 17 by being force-bit. In order to make this possible, the swivel pin 20*f* has the shape of a wedge. The surface 23 is divided into two surface sections 23*a*, 23*b* that, together, subtend an obtuse angle. The surface section 23*a* adjoining the end face 21 is inclined at an acute angle relative to the longitudinal central axis 35. The longitudinal central axis 35 represents the axis of symmetry of the cylindrical section 25. The surface section 23*b* adjoins an edge 36 on the surface section 23*a*, said edge extending in circumferential direction of the swivel pin 20. At its other end, the surface section 23*b* adjoins the optional abutment surface 24. The surface section 23*b* is preferably aligned parallel to the longitudinal central axis 35. The distance between the edge 36 and the abutment surface 24 is preferably slightly greater than the thickness of the latch 10. The surface section 23*b* is preferably positioned in such a manner that a force fit is established between the latch 10 and the swivel pin 20*f*. The inclination of the surface section 23*a* is preferably such that the end of the swivel pin 20*f* located on the end face 21 fits into the latch hole 17 with play. When the swivel pin 20*f* is inserted, the desired force fit is established between the swivel pin 20*f* and the latch 10. The force-fit secures the swivel pin 20*f* in axial direction, while the positive connection guarantees the non-rotational coupling.

The knitting needle 1 comprises a novel bearing arrangement 16 for its latch 10. The bearing arrangement 16 comprises a swivel pin 20 that is positively and non-rotationally coupled with the latch. An anti-loosening safety may be provided on the base body 2 of the latch needle 1 in order to axially secure the swivel pin 20 in the latch hole 17. Alternatively, the swivel pin 20 may be connected with the latch 10 in order to axially secure said swivel pin.

It will be appreciated that the above description of the present invention is susceptible to various modifications, changes and modifications, and the same are intended to be comprehended within the meaning and range of equivalents of the appended claims.

LIST OF REFERENCE NUMERALS

1 Latch needle
2 Needle body
3 Hook
4 Driving foot
5 Latch slot
6 Needle breast
7 Needle back
8, 9 Walls, slot walls
10 Latch
11 End
12, 13 Lateral surfaces
14 End
15 Recess
16 Bearing arrangement
17 Latch hole
18 Part having the form of a circular arc
19 Straight part
20 Swivel pin 20*a*, . . . , 20*f*
21, 21' End face
22 First section
23, 23' Surface, flattened area
23*a*, 23*b* Surface sections
24 Abutment surface
25 Section
26, 27 Wall hole
28 Anti-loosening safety
29, 30 Regions
31 End face
32 Surface
33 Notch
34 Rivet head
35 Longitudinal central axis
36 Edge
41 Latch shaft

What is claimed is:

1. Latch needle, comprising:

a needle body having a needle slot delimited by two slot walls, a latch having a latch shaft extending into the slot and having a latch hole on this latch shaft, said latch hole being in alignment with wall holes that are provided in the slot walls, a swivel pin that extends through the latch hole and into the wall holes and is non-rotationally held in the latch hole, and wherein:

the latch hole has a non-round cross-section; and the swivel pin has a first section with a cross-section matching the cross-section of the latch hole, and a second section having an abutment surface facing and abutting against a lateral surface of the latch shaft to axially position the latch on the swivel pin.

2. Latch needle in accordance with claim 1, wherein the first section of the swivel pin is configured as a cylinder, provided with at least one flattened area.

3. Latch needle in accordance with claim 1, wherein the first section of the swivel pin is configured as a cylinder provided with at least one notch.

4. Latch needle in accordance with Claim 1, wherein the cross-section of the second section deviates from the cross-section of the first section.

5. Latch needle in accordance with claim 1, wherein each of the wall holes has a circular cross-section.

6. Latch needle in accordance with claim 5, wherein the swivel pin is held in the latch hole in a force-fit manner.

7. Latch needle in accordance with claim 1, wherein the swivel pin is seated with play in the wall holes.

8. Latch needle in accordance with claim 1, wherein at least one of the slot walls is provided with an anti-loosening safety means for preventing the swivel pin from being able to fall out of the needle body.

9. Latch needle in accordance with claim 8, wherein the anti-loosening safety means is formed by an edge of the wall hole of the respective slot wall, said edge being deformed at least in parts.

10. Latch needle in accordance with claim 8, wherein the wall hole of the slot wall provided with the anti-loosening safety means accommodates the second section of the swivel pin.

11. Latch needle in accordance with claim 1, wherein said second section of said swivel pin has a diameter that is greater than the diameter of said first section of said swivel pin.

12. Latch needle in accordance with claim 1, wherein the axial length of said first section of said swivel pin is equal to the axial length of said second section of said swivel pin plus the thickness of said latch shaft.

* * * * *